US008287220B2

(12) United States Patent
Oberholzer et al.

(10) Patent No.: US 8,287,220 B2
(45) Date of Patent: Oct. 16, 2012

(54) METHOD AND DEVICE FOR MANUFACTURING PEEL-OFF LIDS

(75) Inventors: Marcel Oberholzer, Bergdietikon (CH); Peter Schreiber, Ipsach (CH)

(73) Assignee: Soudronic AG, Bergdietikon (CH)

( * ) Notice: Subject to any disclaimer, the term of this patent is extended or adjusted under 35 U.S.C. 154(b) by 124 days.

(21) Appl. No.: 12/832,412

(22) Filed: Jul. 8, 2010

(65) Prior Publication Data

US 2011/0168713 A1 Jul. 14, 2011

(30) Foreign Application Priority Data

Jul. 9, 2009 (CH) ..... 1068/09

(51) Int. Cl.

| | |
|---|---|
| ***B23P 11/00*** | (2006.01) |
| ***B21D 51/46*** | (2006.01) |
| ***B21D 51/26*** | (2006.01) |
| ***B21D 39/00*** | (2006.01) |
| ***B65D 51/18*** | (2006.01) |
| ***B65D 17/34*** | (2006.01) |
| ***B65D 41/00*** | (2006.01) |
| ***B65D 53/00*** | (2006.01) |
| ***B65B 7/16*** | (2006.01) |
| ***B67B 7/16*** | (2006.01) |
| ***B67B 1/00*** | (2006.01) |
| ***B67B 3/00*** | (2006.01) |
| ***B67B 5/00*** | (2006.01) |
| ***B67B 3/04*** | (2006.01) |
| ***B60J 10/00*** | (2006.01) |
| ***B29C 65/00*** | (2006.01) |
| *B21D 51/28* | (2006.01) |

(52) U.S. Cl. ..... 413/62; 413/73; 220/254.1; 220/270; 220/359.1; 220/359.2; 53/441; 53/484; 53/487; 156/221; 156/443; 29/505; 29/509; 29/521; 29/243.5; 29/243.58

(58) Field of Classification Search ..... 220/359.1, 220/359.2, 254.1, 270; 413/62, 73; 53/441, 53/484, 487; 156/221, 443; 29/505, 509, 29/521, 243.5, 243.57, 243.58
See application file for complete search history.

(56) References Cited

U.S. PATENT DOCUMENTS

| | | | | |
|---|---|---|---|---|
| 2004/0065663 | A1* | 4/2004 | Turner et al. | 220/254.1 |
| 2006/0151503 | A1* | 7/2006 | Claydon | 220/359.1 |
| 2008/0253863 | A1* | 10/2008 | Heyn | 413/4 |

FOREIGN PATENT DOCUMENTS

| | | | |
|---|---|---|---|
| FR | 2687633 | A1 | 8/1993 |
| WO | 2005019047 | A2 | 3/2005 |
| WO | 2005070585 | A1 | 8/2005 |
| WO | 2007045385 | A1 | 4/2007 |

OTHER PUBLICATIONS

European Search Report dated Jul. 1, 2011.

* cited by examiner

*Primary Examiner* — Anthony Stashick
*Assistant Examiner* — Andrew T Kirsch
(74) *Attorney, Agent, or Firm* — McCormick, Paulding & Huber LLP

(57) ABSTRACT

In the area of manufacturing peel-off lids (28) out of lid rings with a peel-off foil (25) sealed on it, a part of the sealing surface (26) is bent up in the direction of the lid edge in order to tension the sealing surface with the peel-off foil. A clamping tool (30, 31) is provided in order to clamp the sealing surface with the peel-off foil and a pressing tool (35) in order to bend up the unclamped sealing surface section (26').

9 Claims, 4 Drawing Sheets

METHOD AND DEVICE FOR MANUFACTURING PEEL-OFF LIDS

CROSS REFERENCE TO RELATED APPLICATIONS

This application claims the priority of Swiss patent application 1068/09, filed Jul. 9, 2009, the disclosure of which is incorporated herein by reference in its entirety.

BACKGROUND OF THE INVENTION

The invention relates to a method for manufacturing peel-off lids, in which a lid ring is provided having a flanged rim and a sealing surface bordering said flanged rim and the lid ring opening and in which subsequently a peel-off foil is sealed onto the sealing surface. Furthermore, the invention relates to a peel-off lid according as well as to a device for manufacturing peel-off lids.

PRIOR ART

It is known to produce lids for can-like or box-like packages as metal lids which are permanently attached on top of the package and which have an opening which is sealed until the first use of the package contents by means of a peelable foil, which was applied on the lid by heat-sealing. Such lids are called peel-off lids. The peel-off foil, which is also called sealing foil, may for example be a plastic foil or a plastic-metal composite foil. An additional plastic lid arranged above the peel-off lid closes the package during the consumption period of the contents. For the first opening of the peel-off lid or for peeling off the sealed foil, respectively, from the sealing rim of the lid ring, the foil normally has a peel-off tab.

During the closing of a container or of a can after its filling, the prefabricated peel-off lid is flanged at the body of the can. For this, the peel-off lid has a flanged rim serving for the flange connection to the body of the container or can, respectively, as known.

Known methods or devices, respectively, for the manufacturing of peel-off lids will be explained in the following by means of FIGS. 1 to 6 and FIGS. 2 to 6 serve in particular to explain manufacturing steps.

In case of peel-off foils made of plastic or of plastic-metal composite foils, the foil often may be insufficiently stretched after the finishing and it may show a "wavy" shape above the lid ring opening, this being felt as deficiency by the purchasers of peel-off foils.

WO 2005/019047 shows a peel-off lid where the sealing rim is bent up in the direction of the top lid edge directly after the flanged rim. By this, the retention force at the sealing rim shall be improved. WO 2005/005277 also shows a peel-off lid where the sealing rim is bent up directly after the flanged rim. The retention force of the peel-off lid is also supposed to be improved by avoiding peeling forces. Furthermore, WO 2007/045385 shows a peel-off lid with a sealing surface which is bent up directly after the flanged rim.

BRIEF SUMMARY OF THE INVENTION

The object of the invention is to improve peel-off lids in particular by avoiding the presence of waves in the peel-off foil on the finished peel-off lid.

This task is solved in the context of the aforementioned method for manufacturing peel-off lids in that for tensioning the peel-off foil after the sealing step, a section of the sealing surface which neighbours the flanged rim and has the peel-off foil sealed thereon is fixed between an upper and a lower flat clamping tool, and in that the sealing surface which is not acted upon by the clamping tools is bent in the direction towards the upper lid edge by means of a pressing tool.

A flat section of the sealing rim is created by the clamping of the sealing rim with the peel-off foil with flat clamping tools and only a neighbouring section bordering the extraction opening is bent up in order to create the tension of the peel-off foil for avoiding waves. Raising up or bending up respectively directly after the flanged rim or the slope of the flanged rim, as it is the result in case of the prior art mentioned at the beginning, is thereby avoided. This prior art method doesn't lead to a sufficient tension of the peel-off foil because spring back effect in this area is very high after the bending up step. Upon drawing the lid ring, this section has already been subject to considerable strain and the metal-sheet thickness is normally reduced compared to the initial metal-sheet thickness. This thinning also means an increase in material hardness. In case of the claimed process according to the invention metal-sheet material with the initial metal-sheet thickness is deformed, wherein virtually no spring back effect results and a permanent tension of the peel-off foil can be obtained. Furthermore, a peel-off lid results by the present invention, which can be worked upon without problems with the ordinary flanging tools when the lid is flanged to the container or can body, respectively.

According to a preferred embodiment, substantially the retort-curl only is bent up in order to tension the peel-off foil and the actual sealing surface remains flat on its entire width and runs horizontally. In another embodiment, a section of the sealing surface is bent up. A bending-up of few degrees with respect to the horizontal plane is normally sufficient for avoiding waves in the peel-off foil by the tension of the foil.

Furthermore, the task is solved by a peel-off lid according the invention as well as by the manufacturing device according to the invention.

BRIEF DESCRIPTION OF THE DRAWINGS

In the following the prior art and embodiments of the invention will be further explained by means of the figures. Thereby it is shown in.

DESCRIPTION OF PREFERRED EMBODIMENTS

Figure 1:
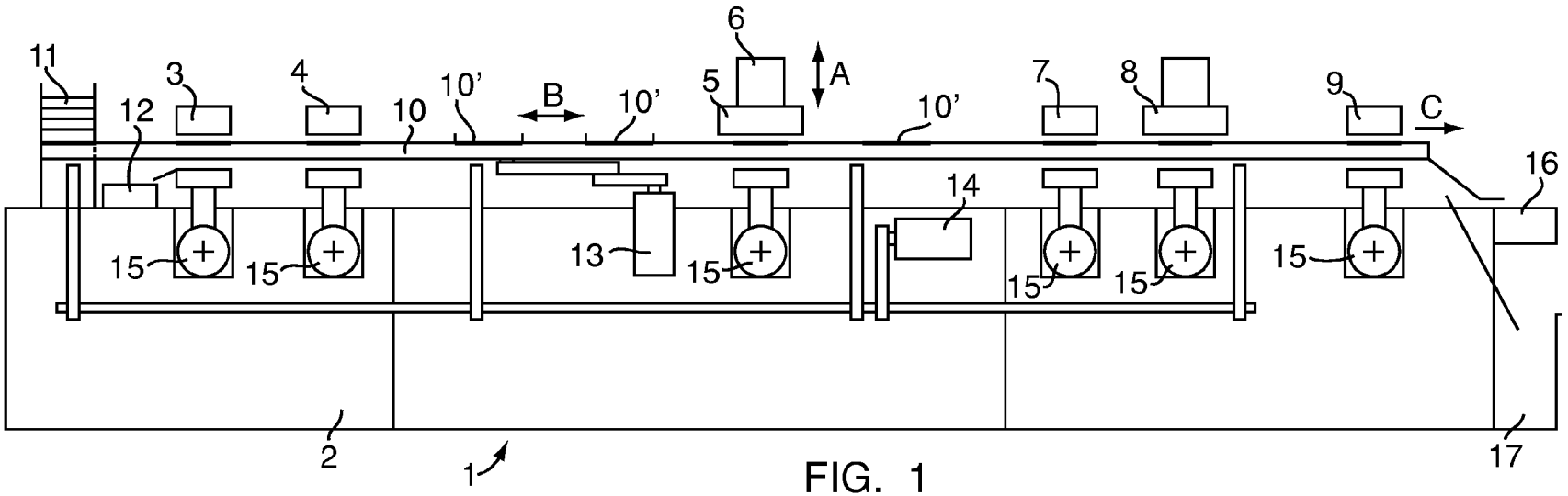
FIG. 1 a schematical side view of a device according to the prior art as well as for carrying out the present invention.

FIG. 1 shows a schematical side view of a device for manufacturing peel-off lids. It has multiple processing stations 3 to 9 on a machine frame 2. A conveying arrangement 10, 13, 14 conveys lid parts and the finished lids in a conveying direction, which is indicated by arrow C, from the beginning of the device at a stack 11 to the end of the device where the lids get into trays 16 or 17 via slides. Lid parts are destacked from the stack 11 in a known way and enter into the conveying arrangement. The latter may have two long rails 10, each of which is arranged on the side of the objects and which lift up the lid parts or the lids lying on trays 10' or in the stations 3 to 9 respectively during the lift-up of the rods 10 by means of the actuator 14 in the direction of the arrow A and shift them forward by an amount, in a forward movement, in the direction of the arrow B (of same orientation as the arrow C) by means of the crank mechanism 13. After that, the rods are moved downwards in the direction of the arrow A, wherein the lid parts and the lids are again placed on their trays. Subsequently, the rods 10 are moved back under the object tray positions in the arrow direction B against the arrow C, and the described process is subsequently carried out again. The lid parts or the lids respectively remain on their tray positions between the transport steps or are located within the processing stations and are processed therein. After a processing step of all processing stations the conveying takes place again. Preferably, a known conveying arrangement with two toothed belts according to WO 2006/017953 may be used instead of the described conveying arrangement. Such an endless toothed belt actuator is provided in a length which is necessary for the number of the processing stations and the stepwise toothed belt movement which is synchronised with the processing stations is triggered by a step motor or servo motor which actuates the toothed belt by means of toothed rollers. The conveying arrangement with toothed belts allows the manufacturing of lids with a high cycle number of for example 200 lids per minute.

Figure 2:
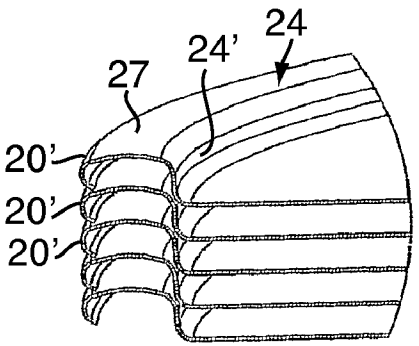
FIG. 2 to FIG. 6 sectors of metal lids for explaining their manufacture.
Figure 3:
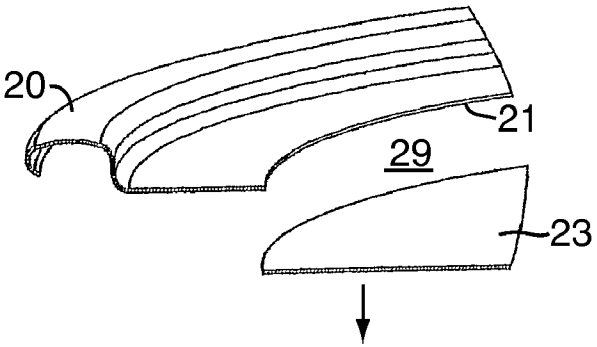
Figure 4:
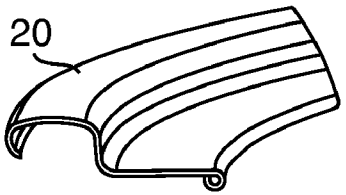
Figure 5:
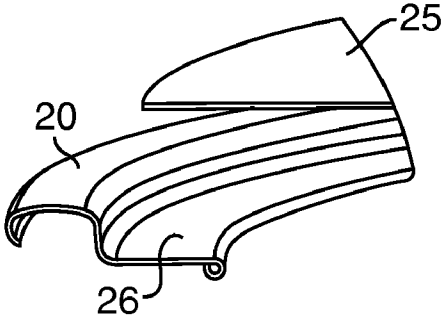
Figure 6:
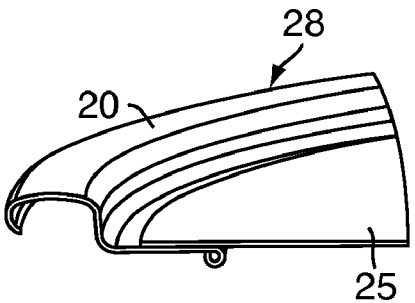
Figure 7:
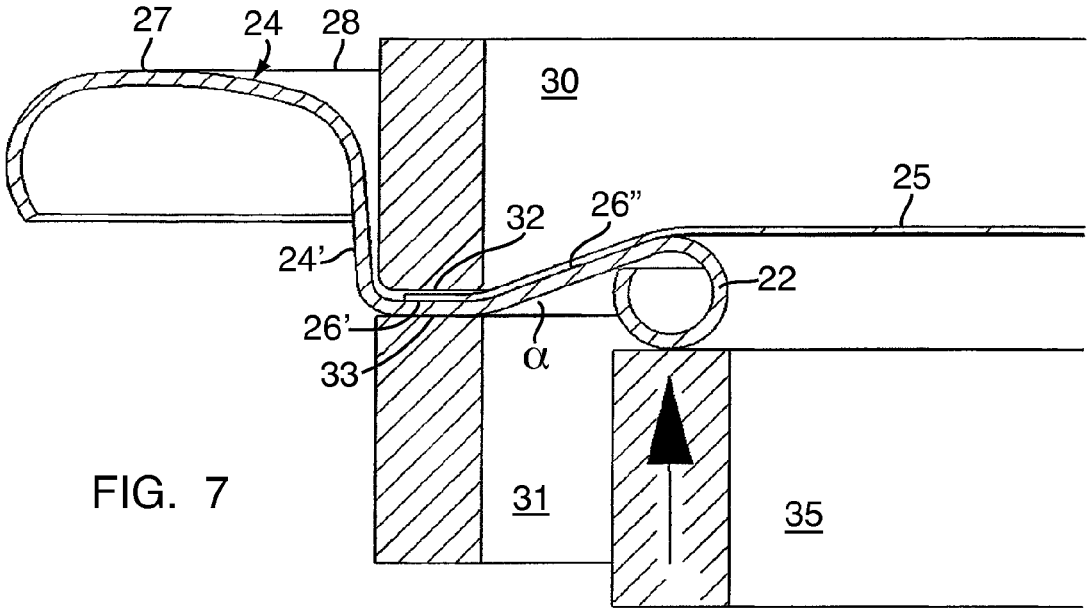
FIG. 7 a section view of a first embodiment according to the invention, wherein the section through a part of the peel-off lid and through a part of the tools used for it is shown.
Figure 8:
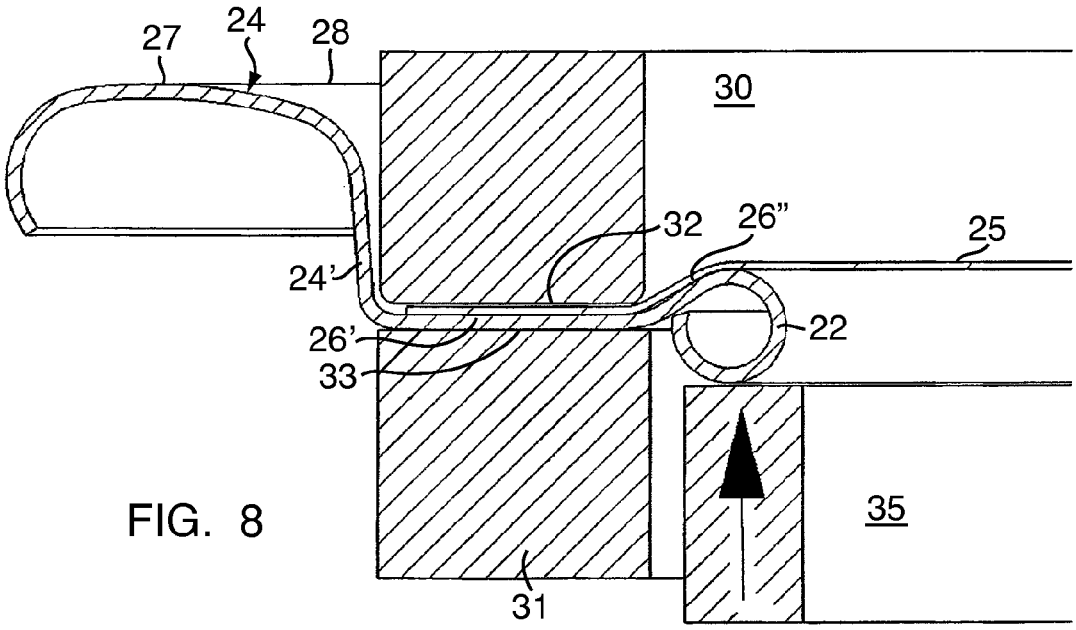
FIG. 8 a section view of a second embodiment according to the invention, wherein the section through a part of the peel-off lid and through a part of the tools used for it is shown.
Figure 9:
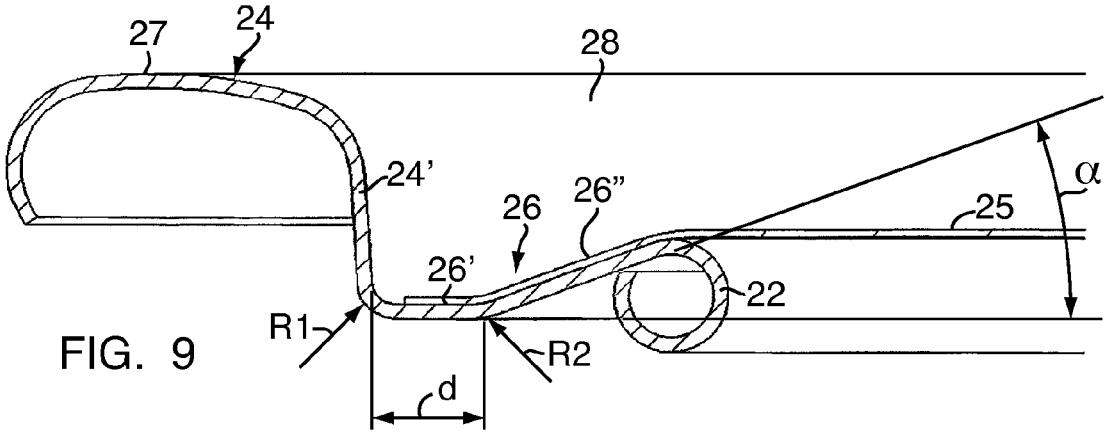
FIG. 9 a section view of a part of a finished peel-off lid according to the invention.

FIG. 2 shows stacked metal lid blanks 20', as they are provided in the stack 11 at the beginning of the conveying installation. These blanks 20' are for example round metal disks with a diameter of for example 11 cm. Of course, other basic shapes, for example square or rectangular disks, and different diameters, can be used as well. The blanks 20' have been preformed at their outer rim in a processing station which is not shown, in such a way that a flanging rim 24 with its slope 24' and its upper side 27 has been shaped, which also forms the upper side 27 of the peel-off lid. This flanging rim 24 serves, in a known way, for fixing the peel-off lid to the body of the container or can, respectively, which is closed by the lid after its filling with a product. In FIG. 2 and the following FIGS. 3 to 6, only a section of the lid ring or the lid, respectively, is shown in order to simplify the drawings. In the first processing station 3 of FIG. 1, an opening 29 is punched into the disk by means of a punching process with an upper and a lower tool, which is shown in FIG. 3, where the edge of the opening is denoted by 21, by the round disk 23 which has been punched out. This disk 23 is disposed of in the container 12 of FIG. 1. Thus, a ring-shaped lid part 20 or a lid ring 20, respectively, is the result, with an opening 29 which forms the opening of the finished lid which serves later as opening of the container or can, respectively. The punching processing station 3 is actuated by an actuator 15, as this is the case for the following stations. Within the processing station 4 a pulling down of the edge 21 and a reforming are carried out, by means of which the rolled-in shape of the edge is reached, which is for example shown only schematically in FIG. 4, forming a so called "retort-curl", as shown in FIGS. 7 to 9, but which may also form another edge shape, as it is common for peel-off lids. The lid rings 20 then get into the sealing station 5. Within this station, a foil section 25 is punched out in a known way and is placed above opening 29 of the lid ring 20 and is sealingly attached there by heat-sealing, this being shown in FIGS. 5 and 6. The plastic foil or composite foil forming the peel-off foil section 25 is provided with a sealable plastic layer at its bottom side, as known. The peel-off foil may for example be a multiple layer foil with plastic layers and aluminium layers. It may for example have a layer of heat sealable polypropylene (PP) and a subsequent layer of PET, being followed by an aluminium layer and having another PET layer on the upper side of the peel-off foil. A printing may be arranged under this PET layer. A further embodiment of the peel-off foil may use a heat sealing paint layer arranged at the underside of the lid or at the contents side, respectively, being followed by the aluminium layer and the PET layer on the upper side of the lid. Also further embodiments are known to the skilled person and may be used within the scope of the present invention. The cut foil 25 needed, which in this example has a round shape, is normally punched out of a wide foil web within station 5, is then placed above the opening 29 of the lid ring. The foil is pressed by the sealing station to the edge area of the opening or the sealing surface 26, respectively, of the lid ring 20 under the influence of heat, such that foil 25 is sealed tightly to the metal lid ring 20 by melting and subsequent cooling of the sealable layer. This is well known to the skilled person and will therefore not be explained in more detail here. A peel-off lid 28 consisting of lid ring and peel-off foil is thereby formed. For the following processing for tensioning the peel-off foil according to the present invention the processing station 7 following the sealing station is provided. If the peel-off foil is provided with a peel-off tab, the tab may then be folded back and attached in a processing station 8, such that it comes to lie on the lid. The sequence of the stations 7 and 8, respectively, may also be switched. The now finished lids are submitted to an inspection in an inspection station 9 according to the prior art, which is to be considered a processing station, normally comprising a leak test for the peel-off foil 25 applied on the lid. If the foil is tightly attached to the lid ring, the lid thereby ends up in the tray 16 for the finished lids. If a leak is detected, the lid ends up in the waste container 17 via the other shown slide.

According to the present invention the peel-off foil is tensioned after it has been sealed onto the lid ring. This may for example be done in the station 7 following the sealing station 5 of FIG. 1. FIGS. 7 and 8 show a first and a second example, respectively, for the processing of lid 28. Same reference numerals denote again same elements as before. Reference to a "horizontal plane" is made in the sense that the lid would lie with its bottom side on a horizontal surface. It is referenced to "up" or "down", respectively, in the sense of the relation to the position of the lids in FIGS. 7 to 9, where the upper side 27 of the flanging rim 24 lies "on top". In FIGS. 7 to 9 only a part of the lid and of the tools is shown. The tools of this example are rotationally symmetrical to a central vertical axis, as is the round lid of this example.

When processing lid 28 in order to tension the peel-off foil 25, the lid is clamped at its sealing surface 26 into a clamping tool with an upper clamping jaw 30 and a lower clamping jaw 31. The clamping jaws 30 and 31 have flat clamping surfaces 32 and 33, such that a clamping of the sealing surface without deforming the sealing surface takes place. A first embodiment is shown in FIG. 7, wherein clamping of a first straight section 26' of the sealing surface occurs, which neighbours or follows directly on, respectively, the flanging rim slope 24', and wherein a second straight sealing edge section 26" neighbouring or following directly to, respectively, the first section 26' is not clamped. The other end 22 of the sealing surface follows directly to this second section 26", said end 22 being a preferably formed, and preferably rolled-in, edge area which limits the opening 29 of the lid. Preferably, the edge area is executed as a so-called "retort-curl" with the shown shape. The straight section 26" which initially runs horizontally is then bent up after the clamping by the clamping tools by a further tool 35 which is moved up in the direction of the arrow. FIG. 7 shows the end position of the bending process, in course of which a bending-up by the desired angle α has occurred. In the shown preferred embodiment the bending takes place by means of tool 35 in such a way that it only engages the rolled-in edge area 22 and does not directly engage section 26" of the sealing surface. After this permanent deformation of the sealing surface 26 in the transition area between the sections 26' and 26" the pressing tool 35 may be driven down again. The lid is taken out of the processing station and conveyed further and a next lid is transported into the processing station 7 in order to be processed there in the described way. The angle α for tensioning the foil 25 may only have a value of few degrees and may for example be in the range of 3 to 9 degrees. In the figures, a wider angle is shown for a better illustration.

FIG. 8 shows a preferred embodiment, in which same reference numerals denote same elements again. Here, the clamped section 26' of the sealing surface 26 impinged by the clamping tools comprises substantially the entire area from the flanging rim slope 24' to the other end of the sealing surface, wherein this end 22 is again preferably formed as rolled-in edge. Substantially only the rolled-in edge is then bent up and forms the section 26" in this example while the entire rest of the sealing surface 26 is clamped or impinged respectively and forms section 26' in this example. By this, substantially the entire sealing surface remains horizontal and flat and only the rolled-in edge is bent up. By this, the tensioning of the peel-off foil 25 is attained as well.

FIG. 9 shows a lid 28 which was manufactured according to the method explained with reference to FIG. 7. The angle α is selected for example as having a value within the range of 3 to 30 degrees, preferably however only 3 to 9 degrees. The width d of the ring-shaped section 26' is for example about 2.5 mm. Radii R1 and R2 are shown. By means of these radii, the difference to the prior art as mentioned at the beginning may be explained again, since the lift-up or bend-up, respectively, of the prior art lids is done directly following the flanging rim or the slope of the flanging rim, respectively, or in other words it is done where the radius R1 is shown. This is avoided by the present invention and the bend-up is done at where radius R2 is shown. The process according to the prior art with the radius R1 doesn't lead to a sufficient tension of the peel-off foil because the spring back effect after the bending-up is very high in this area. Upon drawing down the lid ring, this area has already been subject to substantial strain and the metal sheet thickness is normally reduced by the drawing process to a thickness smaller than the initial metal sheet thickness. This thinning also results in an increase of the material hardness and hence of the spring back effect; however, because no tensioning at all of the peel-off foil is intended in case of the prior art mentioned before, this spring back effect has no negative influence in the prior art. In case of the present invention, contrary to the prior art, metal sheet material with the initial sheet material thickness is deformed when bending-up at the position of radius R2 with the method according to the invention, wherein there is practically no spring back effect and a permanent tension of the peel-off foil can be reached.

Figure 10:
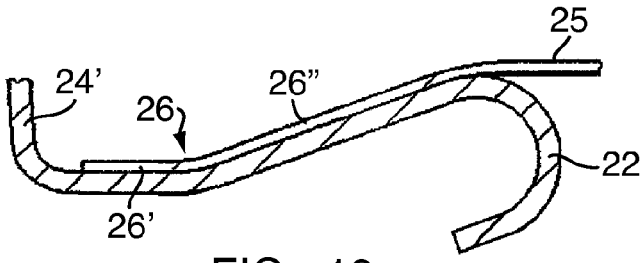
FIG. 10 a further form of the edge of the extraction opening.
Figure 11:
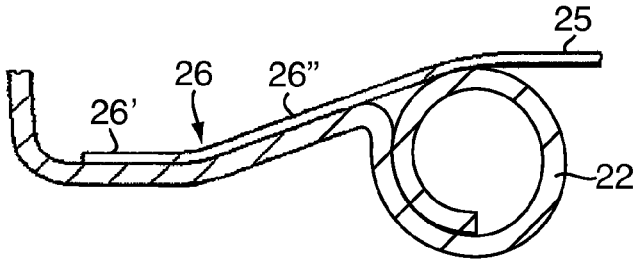
FIG. 11 another form of the edge of the extraction opening.

FIG. 10 and FIG. 11 show further preferred embodiments of the edge of the extraction opening, as they may also be used for the present invention.

The invention claimed is:

1. A method for manufacturing peel-off lids, in which first a lid ring is provided, having a flanging rim and a sealing surface joining its flanging rim slope, wherein the sealing surface borders the lid ring opening with its other end, and subsequently a peel-off foil is sealed onto the sealing surface, and wherein in order to tension the peel-off foil after the sealing step a section of the sealing surface following the flanging rim slope is clamped together with the peel-off foil between an upper and a lower clamping tool having flat clamping surfaces, and a section of the sealing surface which is free of the clamping tools is bent in a direction of the upper lid edge by means of a pressing tool, and wherein the said other end of the sealing surface is shaped as a rolled-in edge area and the pressing tool engages only this edge area.

2. The method according to claim 1, wherein said clamping tools clamp the sealing surface in a section which extends from said flanging rim slope to the border of said rolled-in edge area.

3. The method according to claim 2, wherein said rolled-in edge area is bent up in an angle of maximum 45 degrees with respect to the horizontal plane.

4. The method according to claim 3 wherein said rolled-in edge area is bent up in an angle of 3 degrees to 9 degrees to the horizontal plane.

5. The method according to claim 1, wherein the clamping tool clamps the sealing surface in a first section extending from the flanging rim slope to a straight, unclamped second section of the sealing surface following the first section, wherein the second section extends further to said other end of the sealing surface which is formed as said rolled-in area.

6. The method according to claim 5, wherein the unclamped second section of the sealing surface is bent up in an angle of maximum 45 degrees with respect to the horizontal plane.

7. The method according to claim 6 wherein said unclamped second section of the sealing surface is bent up in an angle of 3 degrees to 9 degrees with respect to the horizontal plane.

8. Peel-off lid manufactured according to the method according to claim 1, wherein the peel-off lid has a first flat section of the sealing surface running horizontally and joining directly to the slope of the flanging rim with its one end and joining directly and with a radius R2 to a second section of the sealing surface which is bent up.

9. Peel-off lid according to claim 8, wherein said second section is substantially formed by the other end of the sealing surface only, which is formed as said rolled-in area.

* * * * *